United States Patent [19]

Dinkelmann

[11] Patent Number: 4,964,269

[45] Date of Patent: Oct. 23, 1990

[54] APPARATUS FOR TRANSPORTING SPINNING TUBES TO AND FROM A TEXTILE SPINNING MACHINE

[75] Inventor: Friedrich h Dinkelmann, Rechberghausen, Fed. Rep. of Germany

[73] Assignee: Zinser Textilmaschinen GmbH, Fed. Rep. of Germany

[21] Appl. No.: 336,242

[22] Filed: Apr. 11, 1989

[30] Foreign Application Priority Data

Apr. 14, 1988 [DE] Fed. Rep. of Germany ..... 3812342

[51] Int. Cl.[5] ..... D01H 15/00

[52] U.S. Cl. ..... 57/281; 57/90; 242/35.5 A

[58] Field of Search ..... 57/261, 281, 90, 276; 242/35.5 R, 35.5 A

[56] References Cited

U.S. PATENT DOCUMENTS

| | | | |
|---|---|---|---|
| 3,382,659 | 5/1968 | Schulz et al. | 57/276 X |
| 4,432,198 | 2/1984 | D'Agnolo | 57/276 |
| 4,548,029 | 10/1985 | Araki et al. | 57/281 X |
| 4,681,231 | 7/1987 | Ueda et al. | 242/35.5 A X |
| 4,813,222 | 3/1989 | Fukuda et al. | 57/281 X |

FOREIGN PATENT DOCUMENTS

| | | | |
|---|---|---|---|
| 109000 | 5/1984 | European Pat. Off. | 57/281 |
| 502149 | 7/1930 | Fed. Rep. of Germany . | |
| 565372 | 11/1932 | Fed. Rep. of Germany . | |
| 627923 | 3/1936 | Fed. Rep. of Germany . | |
| 1760689 | 2/1972 | Fed. Rep. of Germany . | |
| 2816418 | 10/1979 | Fed. Rep. of Germany . | |
| 3213253 | 10/1982 | Fed. Rep. of Germany . | |
| 3345825 | 6/1985 | Fed. Rep. of Germany . | |
| 47-39740 | 10/1972 | Japan . | |
| 545866 | 2/1974 | Switzerland . | |

*Primary Examiner*—Joseph J. Hail, III

*Attorney, Agent, or Firm*—Shefte, Pinckney & Sawyer

[57] ABSTRACT

An apparatus for transporting spinning tubes along a textile spinning machine for use in supplying empty spinning tubes thereto and removing fully-wound spinning tubes therefrom, includes an endless flexible metal belt having a generally flat lateral extent, a plurality of spinning tube transport members mounted on the belt at spacings therealong, a belt guide arrangement for orienting the belt to travel in an operating path along the spinning machine with its generally flat lateral extent in upstanding facing relation to the spinning machine, and a drive for actuating traveling movement of the belt. Preferably, the apparatus is adapted for a textile spinning machine having spinning stations along each of two opposite sides thereof, the guiding arrangement serving to guide the belt in the aforesaid upstanding disposition along each side of the spinning machine.

6 Claims, 5 Drawing Sheets

Fig. 5
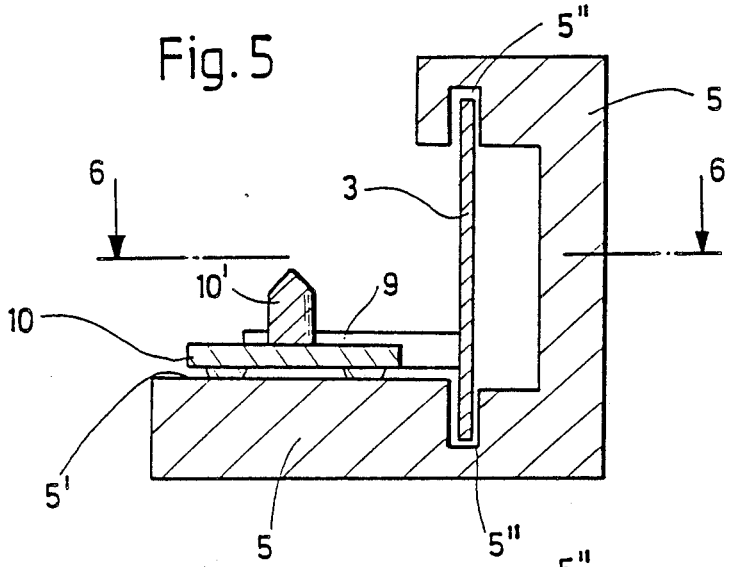
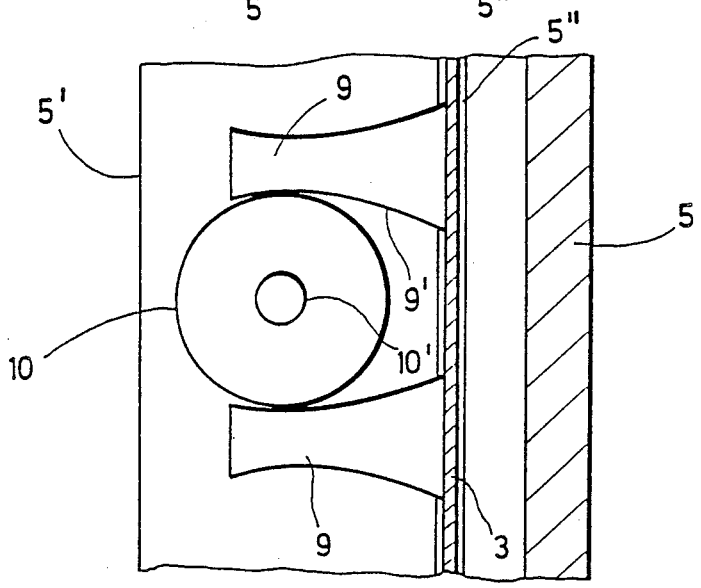
Fig. 6

APPARATUS FOR TRANSPORTING SPINNING TUBES TO AND FROM A TEXTILE SPINNING MACHINE

BACKGROUND OF THE INVENTION

The present invention relates to an apparatus for transporting spinning tubes along a textile spinning machine for use in supplying empty spinning tubes thereto and removing fully-wound spinning tubes therefrom.

Spinning tube transporting apparatus of the aforementioned type are used in particular in textile spinning machines having spinning stations along each of two opposite sides thereof. One known apparatus of this type is disclosed in West German Patentschrift 502,149. In this apparatus, each side of the spinning machine is provided with a respective conveyor located above the machine spindles. Each conveyor includes a length of flexible chain and lengths of cable attached to the opposite ends of the chain, each conveyor being guided about a respective deflection roller at one end of the machine and having the cables attached to take-up drums mounted at the opposite end of the machine for actuating traveling movement of the conveyor. A plurality of hollow cylinders are mounted on each conveyor, alternate cylinders being open at each opposite end thereof and configured for supporting empty spinning tubes and intervening cylinders being open at only one end thereof and configured for supporting fully-wound spinning tubes. The take-up drums of each conveyor actuate conveyor movement in a reciprocal or oscillating fashion to execute a spinning tube replacement procedure, which disadvantageously requires a lengthy time interval and is inefficient in large spinning machines because the return portion of the reciprocal movement serves no function other than to return each conveyor to a starting position.

Japanese Patent No. 47-39740 discloses another known spinning tube transporting apparatus wherein an endless chain is provided for transporting empty spinning tubes and a conveyor belt is provided for transporting fully wound spinning tubes. A mechanism raises the fully wound spinning tubes from their spindles and deposits them onto the conveyor belt and then the same mechanism places empty spinning tubes from the endless chain onto the spindles. Because of the use of two separate conveyors, this known apparatus is both expensive and difficult to automate in design.

Swiss Patent No. 545,866 discloses another type of spinning tube transporting apparatus which utilizes a separate endless conveyor belt at each side of a two-sided textile spinning machine at a location above its spindles. Each of the endless conveyor belts are trained about a pair of deflection rollers located at opposite ends of the machine and are driven by a suitable drive unit. A plurality of fork-like gripper elements are provided on each conveyor belt at spacings corresponding to that of the spinning machine spindles, for grasping spinning tubes. In operation, fully wound spinning tubes are replaced by empty spinning tubes by moving each conveyor belt assembly toward the spindles so that the gripper elements are disposed adjacent the upper end of the fully wound spinning tubes thereon. The conveyor belts are then driven to cause the gripper elements to engage the spinning tubes, after which an associated raising mechanism elevates the conveyor belt assemblies to lift the fully wound spinning tubes from the spindles and the conveyor belt assemblies are then moved away from the spindles for removal of the fully wound spinning tubes. At the same time, the conveyor belts are driven to bring a supply of empty bobbin tubes, held by other gripper elements on the conveyor belts, into disposition over the empty spindles and then the conveyor belt assemblies are lowered to place the empty spinning tubes on the spindles. As will thus be understood, this mechanism is relatively complicated as a result of the various movements to which the conveyor belts must be subjected. Additionally, the procedure for replacing spinning tubes is relatively time-consuming since return movements of the conveyor belts performs no operating function. Further, the provision of separate conveyor belts for each machine side requires separate respective drive units and separate respective mechanisms for supplying and removing empty spinning tubes and fully wound spinning tubes to and from the conveyor belts. Thus, this apparatus is also expensive and difficult to automate.

SUMMARY OF THE INVENTION

It is accordingly an object of the present invention to provide an apparatus for transporting spinning tubes to and from a textile spinning machine, particularly two-sided spinning machines having spindles along each of two opposite machine sides, which is of a simplified design suitable for easy automation.

Briefly summarized, the spinning tube transporting apparatus of the present invention includes an endless flexible metal belt having a generally flat lateral extent, a plurality of spinning tube transport members mounted on the belt at spacings therealong, a mechanism for guiding the belt for travel in an operating path along the spinning machine with the flat lateral extent of the belt in generally upstanding facing relation to the spinning machine, and a drive for actuating traveling movement of the belt. Preferably, the apparatus is utilized with textile spinning machines having spinning stations along two opposite sides thereof, the guiding mechanism in such cases being arranged for guiding the belt to travel along each side of the textile spinning machine with the flat lateral extent of the belt in upstanding relation. Advantageously, this arrangement requires only one drive belt, only one associated drive unit, and only one associated mechanism for removing fully wound spinning tubes from the belt and supplying empty spinning tubes to the belt, all of which considerably facilitates automation of the apparatus. At the same time, the belt is not required to execute any non-functional return movements. The use of a flexible metal belt, preferably steel, is particularly economical and requires low maintenance.

The belt, which is trained about suitable guide rollers along each side of the spinning machine, may be of any desired length and, therefore, the transport apparatus of the present invention may be employed with substantially any textile spinning machine, including machines of considerable length.

In the preferred embodiment of the apparatus, the belt guiding mechanism includes a belt carrier member which extends generally horizontally alongside the textile spinning machine. The belt carrier member is of a generally L-shaped configuration having a generally upstanding portion and a generally horizontal portion. The upstanding portion of the belt carrier member defines a pair of longitudinal guide slots oriented in superposed facing relation in a common generally vertical plane for slidably receiving opposite lateral edges of the lateral extent of the belt. The horizontal portion of the belt carrier member presents an upwardly facing sliding surface. The transport members are preferably formed of a plastic material and may be fastened to the steel belt by a screw or other suitable fastener or by suspension in a longitudinal slot formed in the belt. Advantageously, this construction of the spinning tube transport members is particularly simple inasmuch as only relatively few component parts are required.

In one embodiment, the transport members on the endless belt comprise tube support elements extending outwardly from the belt in slidable contact with the sliding surface on the horizontal portion of the belt carrier member, each tube support element preferably including a pin for insertion within a spinning tube. In another embodiment, the transport members extend outwardly from the belt in overlying relation to the sliding surface and are configured such that each adjacent pair of the transport members are adapted to partially surround a plate mounted to a spinning tube for sliding the plate and tube as a unit along the sliding surface on the horizontal portion of the belt carrier member. Plates of this type are known in the textile spinning art and are used in various manners as holding fixtures for textile bobbins and spinning tubes. Accordingly, this embodiment of the spinning tube transport members makes the present spinning tube transporting apparatus especially suitable for use in combination with other conventional transport systems. For example, the present apparatus may be arranged with its endless metal belt oriented to deliver the plates and spinning tubes onto a conveyor belt arranged adjacent to the present transport apparatus.

The present apparatus also preferably includes an appropriate mechanism for grasping spinning tubes for moving the tubes from the transport members and supplying the tubes to the transport members. The grasping mechanism may have respective grasping arms for performing each such operation. Advantageously, the present apparatus thus only requires one tube grasping mechanism which simplifies the design of the apparatus and makes especially possible the automation thereof.

BRIEF DESCRIPTION OF THE DRAWINGS

FIG. 5 is a vertical cross-sectional view similar to that of FIG. 3 showing an alternate embodiment of the spinning tube transporting apparatus of the present invention;

FIG. 6 is a horizontal cross-sectional view of the spinning tube transporting apparatus of FIG. 5 taken along line VI—VI thereof.

DETAILED DESCRIPTION OF THE PREFERRED EMBODIMENT

Figure 1:
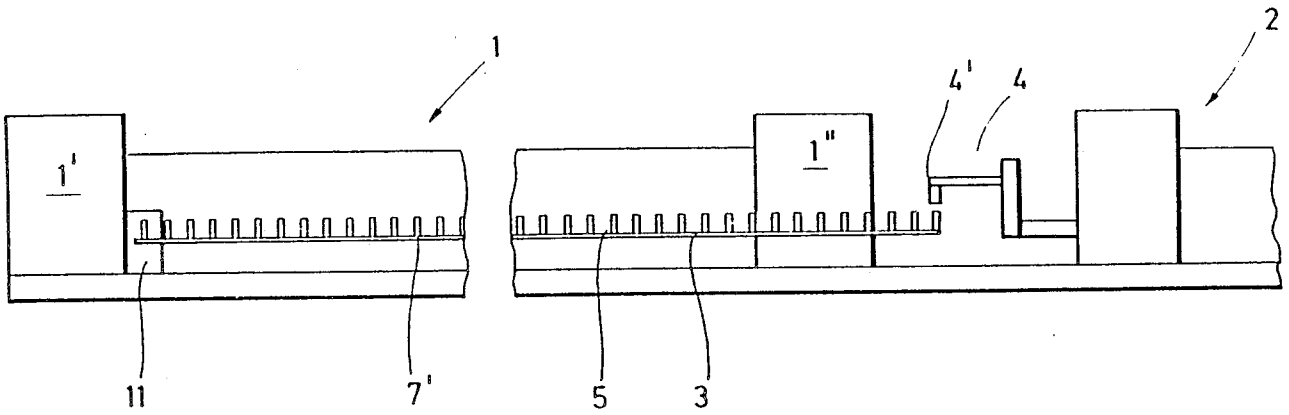
FIG. 1 is a schematic side elevational view of a spinning tube transporting apparatus according to the present invention as preferably embodied for use with a textile spinning machine.
Figure 2:
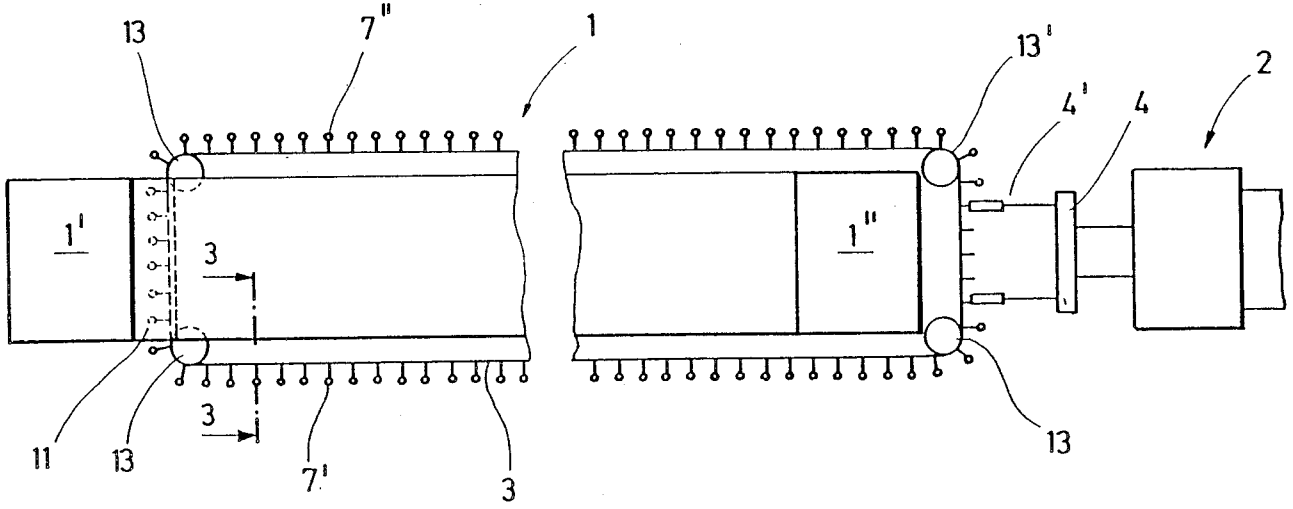
FIG. 2 is a schematic top plan view of the spinning tube transporting apparatus and textile spinning machine of FIG. 1.

Referring now to the accompanying drawings and initially to FIGS. 1 and 2, a conventional textile spinning machine, schematically indicated at 1, and a conventional bobbin winding machine, schematically indicated at 2, are shown as preferably arranged end-to-end adjacent one another for automated, high-throughput operation. For this reason, an efficient spinning tube transport system for removing fully wound spinning tubes from the textile spinning machine and supplying empty spinning tubes to the spinning machine is necessary and desirable.

As seen in FIGS. 1 and 2, the spinning machine 1 is of the conventional type having a plurality of spinning stations along each of two opposite sides thereof. According to the present invention, an endless conveyor belt 3 is arranged to travel about the spinning machine 1 with operating runs of the belt 3 extending along the spindles at each side of the spinning machine. The belt 3 preferably is an endless flexible steel or other metal belt which has a substantially flat lateral extent adapted, as described more fully hereinafter, for removing fully wound spinning tubes 7, from the spindles of the spinning machine 1 and supplying empty spinning tubes 7″ to the spindles of the spinning machine 1.

As shown in FIG. 2, the conveyor belt 3 is trained about a series of guide rollers 13 disposed at opposite sides and opposite ends of the spinning machine 1. One of the guide rollers, indicated at 13′, serves as a drive roller for the conveyor belt 3 and is connected to a suitable drive unit (not shown). The guide rollers 13 are arranged to direct the belt 3 to travel at the end of the spinning machine 1 adjacent the winding machine 2 outwardly about one end frame 1″ thereof and at the opposite end of the spinning machine 1 transversely thereacross inwardly of the opposite end frame 1′ through an opening 11 in the frame of the spinning machine 1. A spinning tube grasping mechanism 4 is located between the spinning machine 1 and the bobbin winding machine 2 and serves to remove fully wound spinning tubes 7′ from, and to supply empty spinning tubes 7″ to, the belt 3. As best seen in FIG. 2, the grasping device 4 preferably includes a pair of grasping arms 4′, 4″ which are respectively adapted for removing fully wound spinning tubes from the conveyor 3 and supplying empty spinning tubes to the conveyor 3. The grasping device 4 may of the type provided with grasping pins adapted to engage interiorly within the hollow interior of the spinning tubes.

Figure 3:
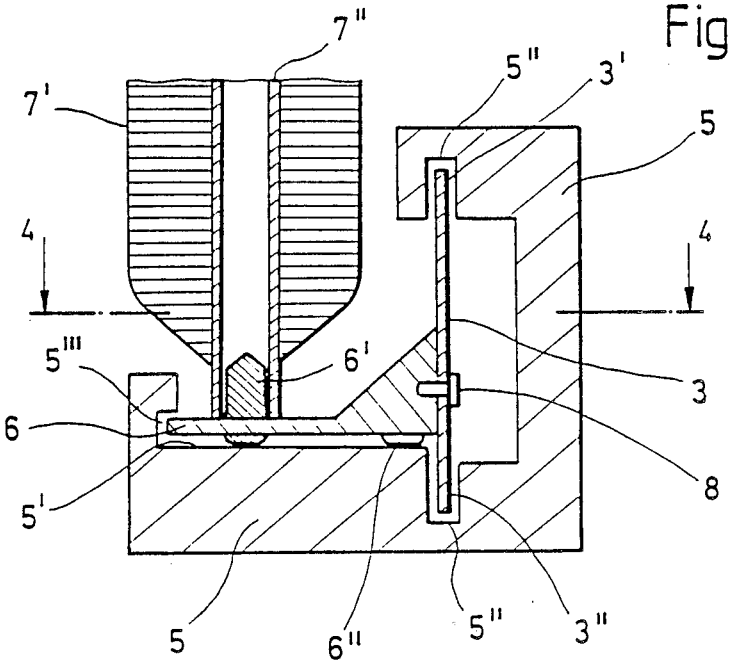
FIG. 3 is a vertical cross-sectional view of the spinning tube transporting apparatus of FIGS. 1 and 2 taken along line III—III of FIG. 2.

According to the present invention, the endless conveyor belt 3 is oriented with its flat lateral extent in a generally upstanding disposition in facing relation to the textile spinning machine 1 and is guided along the opposite sides of the spinning machine 1 by belt carrier members 5, best seen in FIG. 3, affixed horizontally to the spinning machine 1. As seen in FIG. 3, each carrier member 5 has a generally L-shaped cross-section. A pair of guide slots 5″ are formed in the upstanding portion of the belt carrier member 5 in generally superposed facing relation to one another in a common generally vertical plane. The opposite lateral edges 3′, 3″ of the endless belt 3 are slidably received and guided within the guide slots 5′. A plurality of spinning tube transport members are mounted to the endless belt 3 at spacings along its length. In one embodiment shown in FIGS. 3 and 4, the transport members are in the form of spinning tube holding fixtures 6 formed of a plastic material and fastened to one side of the belt 3 by screws 8 or other suitable fasteners to extend outwardly from the belt 3 in generally perpendicular relation thereto. Each holding fixture 6 has a slide member 6'' affixed to its downwardly-facing surface for contact with a sliding surface 5, formed by the upwardly-facing surface of the horizontal portion of the carrier member 5. The horizontal portion of the carrier member 5 also includes a guide slot 5''' which receives and guides the outward edge of the holding fixture 6.

Figure 4:
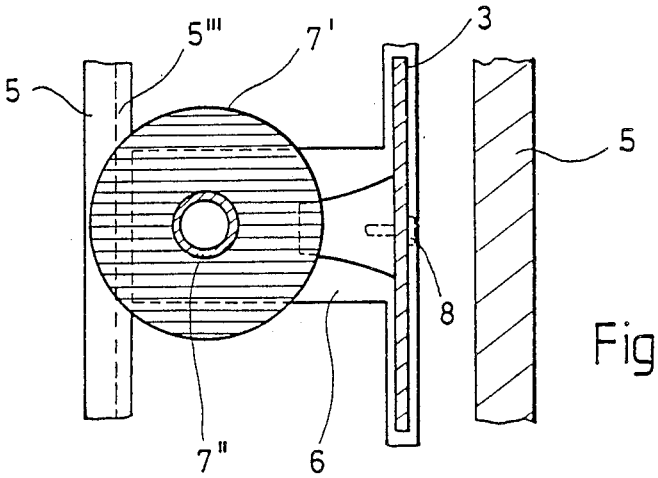
FIG. 4 is a horizontal cross-sectional view of the spinning tube transporting apparatus of FIG. 3 taken along line IV—IV thereof.

Each holding fixture 6 includes an upstanding pin 6' adapted for receipt within the hollow interior of fully wound and empty spinning tubes 7', 7'' for securely supporting the spinning tubes in upstanding disposition on the holding fixtures 6 while permitting easy removal of spinning tubes from, and placement of new spinning tubes onto, the holding fixtures 6. FIG. 4 depicts a horizontal cross-section through the belt carrier member 5, the endless belt 3, the holding fixture 6, and the spinning tube of FIG. 3 taken along line IV—IV thereof.

Referring now to FIGS. 5 and 6, another embodiment of spinning tube transport member is shown as an alternative to the holding fixtures 6 of FIGS. 3 and 4. In FIGS. 5 and 6, a plurality of transport members 9 are affixed generally perpendicularly to the belt 3 at spacings along its length to extend outwardly therefrom in overlying relation to the horizontal portion of the belt carrier members 5 for operation in transporting spinning tube support plates 10 therealong. Spinning tube support plates 10 of this type are well known in the textile art and basically include a circular disk-like base centrally from which a pin 10' extends upwardly for receipt within the hollow interior of a fully wound spinning tube 7' or an empty spinning tube 7''. The plates 10 have feet on their underside to rest slidably on the horizontal sliding surface 5' of the carrier members 5. The transport members 9 are configured with a concave engagement surface 9' at each lateral side thereof generally conforming in shape to the plates 10 and the transport members 9 are spaced from one another along the length of the belt 3 such that each adjacent pair of the transport members 9 are adapted to receive and retain a plate 10 therebetween, eliminating the need for any further guide slot or other guide element on the belt carrier members 5. This embodiment of the present invention will be understood therefore to be particularly suitable for use in combination with other spinning tube transport systems known in the textile art.

Figure 7:
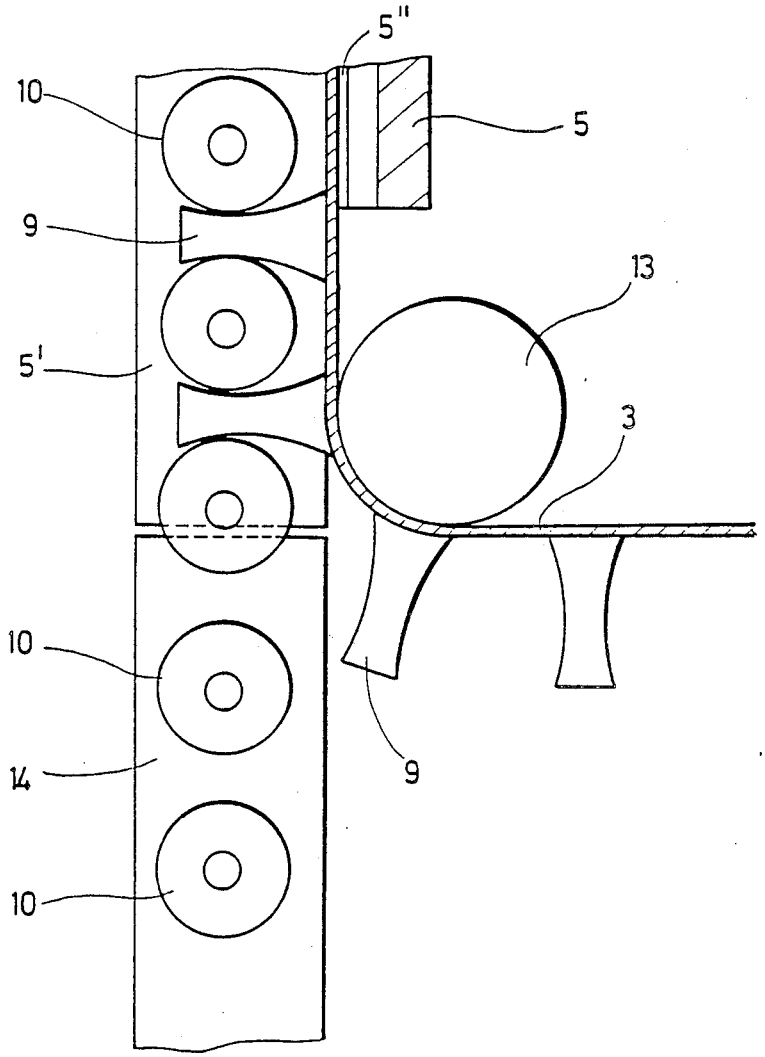
FIG. 7 is a schematic top plan view of the spinning tube transporting apparatus of FIG. 5, shown in combination with an auxiliary conveyor belt.

By way of example, FIG. 7 illustrates the present spinning tube transporting apparatus according to FIGS. 5 and 6 in combination with a horizontally oriented conveyor belt 14 positioned in the area of one guide roller 13 associated with the conveyor belt 3, the belt 14 being located substantially at the same level as the sliding surface 5' of the adjacent belt carrier member 5 so that the plates 10 and spinning tubes supported thereon are fed by the present transporting apparatus from the sliding surface 5' directly onto the essentially co-planar surface of the conveyor belt 14 for continued transportation of the plates 10 and supported spinning tubes.

It is particularly important that the spinning tubes be transported by the conveyor belt 3 as precisely as possible when the grasping device 4 is of the type having grasping pins which engage interiorly into the spinning tubes 7', 7''. It is thereby possible to insert the spinning tubes onto the pins 10' of spinning tube support plates 10 to seat thereon in a frictional connection. In order for the grasping device 4 to subsequently remove spinning tubes from the support plates 10, the transport members 9 or the belt carrier members 5 may be provided with plate retaining elements (not shown) adapted to extend over the plates 10 to prevent them from being raised upwardly with the spinning tubes by the grasping device 4.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. Apparatus for transporting spinning tubes along a textile spinning machine having spinning stations along two opposite longitudinal sides thereof for use in supplying empty spinning tubes thereto and removing fully-wound spinning tubes therefrom, said apparatus comprising an endless flexible metal belt having a generally flat lateral extend, a plurality of spinning tube transport members mounted on said belt at spacings therealong, spinning tube support means associated with said tube transport members, means for guiding said belt for travel in a continuous operating path extending along each opposite longitudinal side of said spinning machine and transversely between the opposite longitudinal sides at the ends of said spinning machine with said generally flat lateral extent in generally upstanding relation facing said spinning machine, and drive means for actuating traveling movement of said belt, said transport members and said support means being cooperatively arranged for transporting in spaced relation along the two opposite longitudinal sides of said spinning machine a plurality of spinning tube support plates each adapted for removably carrying a spinning tube and for automatically releasing the plates at each location in said operating path of said belt whereat the direction of traveling movement of said belt changes from one longitudinal side of said spinning machine to travel transversely to the other longitudinal side of said spinning machine.

2. Apparatus for transporting spinning tubes according to claim 1 and characterized further in that said guiding means comprises a belt carrier member extending generally horizontally alongside said textile spinning machine.

3. Apparatus for transporting spinning tubes according to claim 2 and characterized further in that said belt carrier member defines a pair of longitudinal guide slots oriented in superposed facing relation in a common generally vertical plane for slidably receiving opposite lateral edges of said lateral extent of said belt.

4. Apparatus for transporting spinning tubes according to claim 3 and characterized further in that said belt carrier member has a generally L-shaped configuration including a generally upstanding portion and a generally horizontal portion, said guide slots being formed by said upstanding portion and said horizontal portion presenting an upwardly facing sliding surface.

5. Apparatus for transporting spinning tubes according to claim 4 and characterized further in that said transport members extend outwardly from said belt in overlying relation to said sliding surface and said transport members are configured such that an adjacent pair thereof are adapted to partially surround a plate mounted to a spinning tube for sliding said plate and tube along said sliding surface.

6. Apparatus for transporting spinning tubes along a textile spinning machine for use in supplying empty spinning tubes thereto and removing fully-wound spinning tubes therefrom, said apparatus comprising an endless flexible metal belt having a generally flat lateral extent, a plurality of spinning tube transport members mounted on said belt at spacings therealong, means for guiding said belt for travel in an operating path along said spinning machine with said generally flat lateral extent in generally upstanding relation facing said spinning machine, and drive means for actuating traveling movement of said belt, said guiding means comprising a belt carrier member extending generally horizontally alongside said textile spinning machine, said belt carrier member having a generally L-shaped configuration including a generally upstanding portion and a generally horizontal portion, said upstanding portion defining a pair of longitudinal guide slots oriented in superposed facing relation in a common generally vertical plane for slidably receiving opposite lateral edges of said lateral extent of said belt and said horizontal portion presenting an upwardly facing sliding surface, said transport members extending outwardly from said belt in overlying relation to said sliding surface and said transport members being configured such that an adjacent pair thereof are adapted to partially surround a plate mounted to a spinning tube for sliding said plate and tube along said sliding surface.

* * * * *